US008950313B2

(12) United States Patent
Kenney

(10) Patent No.: US 8,950,313 B2
(45) Date of Patent: Feb. 10, 2015

(54) SELF REGULATING GAS SYSTEM FOR SUPPRESSED WEAPONS

(71) Applicant: RA Brands, L.L.C., Madison, NC (US)

(72) Inventor: Daniel E. Kenney, Cecelia, KY (US)

(73) Assignee: RA Brands, L.L.C., Madison, NC (US)

( * ) Notice: Subject to any disclaimer, the term of this patent is extended or adjusted under 35 U.S.C. 154(b) by 0 days.

(21) Appl. No.: 13/799,734

(22) Filed: Mar. 13, 2013

(65) Prior Publication Data

US 2014/0190344 A1 Jul. 10, 2014

Related U.S. Application Data

(60) Provisional application No. 61/848,471, filed on Jan. 4, 2013.

(51) Int. Cl.
*F41A 5/28* (2006.01)

(52) U.S. Cl.
CPC ..... *F41A 5/28* (2013.01)
USPC ..... 89/193

(58) Field of Classification Search
CPC ..... F41A 5/18; F41A 5/20; F41A 5/22; F41A 5/26; F41A 5/28
USPC ..... 89/191.01, 191.02, 193, 194, 14.3, 14.4
See application file for complete search history.

(56) References Cited

U.S. PATENT DOCUMENTS

| | | | | |
|---|---|---|---|---|
| 678,969 | A * | 7/1901 | McClean | 89/37.01 |
| 960,825 | A * | 6/1910 | Collenoni | 89/126 |
| 1,846,993 | A * | 2/1932 | Destree | 89/193 |
| 3,020,807 | A | 2/1962 | Hailston et al. | |
| 3,568,564 | A | 3/1971 | Badali | |
| 3,968,727 | A | 7/1976 | Hyytinen | |
| 3,990,348 | A | 11/1976 | Vesamaa | |
| 4,085,654 | A | 4/1978 | Panigoni | |

(Continued)

FOREIGN PATENT DOCUMENTS

EP 0158707 A2 10/1985

OTHER PUBLICATIONS

Michael O. Humphries, SIG Sauer SIG556 Classic, Aug. 23, 2012, 2 pages, National Rifle Association, http://www.americanrifleman.org/ArticlePage.aspx?id=1661&cid=4.

(Continued)

*Primary Examiner* — Stephen M Johnson
(74) *Attorney, Agent, or Firm* — Womble Carlyle Sandridge & Rice, LLP

(57) ABSTRACT

A gas system for an autoloading firearm wherein the gas used to cycle the weapon can be restricted automatically through a mechanical shutoff actuated by the installation of a suppressor on the weapon. The gas system could be used to actuate either a piston to mechanically operate the weapon or a gas impingement mechanism wherein the gas is redirected into the bolt carrier assembly to directly actuate the unlocking and cycling of the bolt and bolt carrier group. A gas block for the firearm includes a spring-loaded plunger assembly positioned within a bore of the gas block and oriented parallel to a bore of a barrel of the firearm, the plunger assembly including a regulator plunger, a regulator bushing, a regulator spring, and a regulator cap. Mounting a suppressor over the muzzle depresses the regulator plunger driving it rearward, the rearward movement of the regulator plunger blocking one of gas ports in the gas block to automatically reduce the volume of propellant gases directed into the gas system.

27 Claims, 6 Drawing Sheets

(56) References Cited

U.S. PATENT DOCUMENTS

| | | | |
|---|---|---|---|
| 4,102,243 | A | 7/1978 | Jennie |
| 4,125,054 | A | 11/1978 | Jennie |
| 4,174,654 | A | 11/1979 | Liedke |
| 4,373,423 | A | 2/1983 | Moore |
| 4,389,920 | A | 6/1983 | Dufour, Sr. |
| 4,414,880 | A | 11/1983 | Throner |
| 4,702,146 | A | 10/1987 | Ikeda et al. |
| 4,872,392 | A | 10/1989 | Powers et al. |
| 4,901,623 | A | 2/1990 | Lee |
| 5,218,163 | A | 6/1993 | Dabrowski |
| 5,272,956 | A | 12/1993 | Hudson |
| 5,388,500 | A | 2/1995 | Petrovich |
| 5,959,234 | A | 9/1999 | Scaramucci et al. |
| 6,374,720 | B1 | 4/2002 | Tedde |
| 6,508,160 | B2 | 1/2003 | Beretta |
| 6,715,396 | B2 | 4/2004 | Dionne |
| 6,848,351 | B1 | 2/2005 | Davies |
| 6,971,202 | B2 | 12/2005 | Bender |
| 6,973,863 | B1 | 12/2005 | Jones |
| 7,258,056 | B2 | 8/2007 | Guesnet et al. |
| 7,810,423 | B2 | 10/2010 | Monroe |
| 7,856,917 | B2 | 12/2010 | Noveske |
| 7,891,284 | B1 | 2/2011 | Barrett |
| 7,926,404 | B2 | 4/2011 | Brittingham |
| 7,942,090 | B1 | 5/2011 | Hoffman |
| 7,946,214 | B2 | 5/2011 | Stone |
| 8,042,448 | B1 | 10/2011 | Sylvester et al. |
| 8,061,260 | B2 * | 11/2011 | Kenney et al. ..... 89/193 |
| 8,065,949 | B1 | 11/2011 | Molinari |
| 8,161,864 | B1 | 4/2012 | Vuksanovich |
| 8,201,489 | B2 | 6/2012 | Juarez |
| 8,245,625 | B2 | 8/2012 | Winge |
| 8,250,964 | B2 | 8/2012 | Stone |
| 8,264,653 | B2 | 9/2012 | Oh et al. |
| 8,316,756 | B1 | 11/2012 | Woodell et al. |
| 2005/0115398 | A1 | 6/2005 | Olson |
| 2006/0278205 | A1 | 12/2006 | Axelsson |
| 2009/0229454 | A1 | 9/2009 | Fluhr et al. |
| 2010/0071541 | A1 | 3/2010 | Barrett |
| 2010/0275770 | A1 | 11/2010 | Noveske |
| 2011/0107900 | A1 | 5/2011 | Presz, Jr. et al. |
| 2012/0167749 | A1 | 7/2012 | Young |
| 2012/0167756 | A1 | 7/2012 | Larue |
| 2012/0167757 | A1 | 7/2012 | Gomez |

OTHER PUBLICATIONS

Jacob Gottfredson, Standing ready: Sig Sauers 516 patrol rifle, Guns Magazine, Mar. 1, 2012, pp. 68-70, vol. 58, issue 3, Publishers Development Corporation.

International Search Report dated Jul. 23, 2014 for International Application No. PCT/US2014/010073 filed Jan. 2, 2014.

Written Opinion dated Jul. 23, 2014 for International Patent Application No. PCT/US2014/010073 filed Jan. 2, 2014.

* cited by examiner

SELF REGULATING GAS SYSTEM FOR SUPPRESSED WEAPONS

CROSS-REFERENCE TO RELATED APPLICATIONS

This application claims the benefit of U.S. Provisional Patent Application Ser. No. 61/848,471 filed on Jan. 4, 2013. The specification and drawings of the provisional patent application are specifically incorporated by reference herein. This application is related to co-pending and commonly assigned U.S. application Ser. No. 13/800,031.

TECHNICAL FIELD

The embodiments of the invention generally relate to gas operating systems for firearms and, more particularly, to gas regulation systems for firearms.

BACKGROUND

Semi-automatic firearms, such as rifles and shotguns, are designed to fire a round of ammunition, such as a cartridge or shotshell, in response to each squeeze of the trigger of the firearm, and thereafter automatically load the next shell or cartridge from the firearm magazine into the chamber of the firearm. During firing, the primer of the round of ammunition ignites the propellant (powder) inside the round, producing an expanding column of high pressure gases within the chamber and barrel of the firearm. The force of this expanding gas propels the bullet/shot of the cartridge or shell down the barrel.

In semi-automatic and automatic rifles and shotguns that rely on such gases from firing to drive operation of the firearm, gas from a fired cartridge is directed to the bolt carrier or to a piston assembly for driving the bolt carrier to cycle the action of the firearm. For example, upon firing a cartridge in a firearm having a direct gas impingement system, high-temperature, high-pressure gas follows the exiting projectile down the barrel. A portion of the gas from the fired cartridge travels into a port and along a gas tube, rearwardly to a gas key that is coupled to the bolt carrier and includes an internal port to allow the high-pressure gas to flow against the bolt carrier. As the gas expands, the pressure from the gas drives the bolt carrier and bolt. The bolt carrier and bolt thus translate rearwardly against the return spring located in the buttstock, extracting the empty cartridge. Thereafter, forward movement of the bolt and bolt carrier by the return spring loads a next cartridge from the ammunition magazine and returns the bolt. The bolt returns to a locked position for firing.

SUMMARY

The embodiments disclosed are directed to a system and methods in which the action of installing a suppressor on the weapon directly actuates a regulating mechanism to reduce the initial energy available to a gas operating system and to match operating speeds between suppressed and unsuppressed operation.

In an autoloading firearm, installing a sound suppressor (silencer) on the weapon will typically cause the cyclic operation of the weapon to speed up due to residual pressures in the suppressor and bore of the weapon. Commonly available systems require the manual activation of a regulator to reduce the initial energy available to the operating system to balance the extra energy imparted by the residual bore pressure.

In one embodiment having a gas regulation system, when no suppressor is attached to the muzzle, gas ports in the barrel are free to provide energy to cycle the weapon. When a suppressor is attached to the muzzle, the suppressor depresses a regulator plunger which cuts off one of the gas ports, reducing the amount of gas entering the system to cycle the weapon. The gas ports are sized such that the operating speed of the weapon is nearly identical whether a suppressor is installed on the weapon or not.

In one embodiment, a gas regulation system is provided in which the volume of propellant gas available to cycle an autoloading weapon is reduced automatically by the installation of a suppressor or similar muzzle device through the actuation of a regulator assembly that reduces the cross sectional area of gas ports in the barrel or gas block of an autoloading rifle. One or more of the orifices (gas ports) are blocked or reduced in area by a cut-off mechanism that is mechanically actuated by the installation of the suppressor.

In one embodiment, a self-regulating gas system is provided for an auto loading weapon wherein the weapon includes a barrel having a bore, at least one gas port, and a muzzle. The system includes a gas block attached to the barrel to redirect a volume of propellant gases to cycle the auto loading weapon, the gas block including a plurality of gas ports for directing propellant gases received from the at least one gas port of the barrel into the gas system of the auto loading weapon. A spring-loaded plunger assembly is positioned within a bore of the gas block and oriented parallel to the bore of the barrel, the plunger assembly including a regulator plunger having a plurality of sections, a regulator bushing, a regulator spring, and a regulator cap. Mounting a suppressor over the muzzle depresses the regulator plunger driving it rearward, the rearward movement of the regulator plunger blocking one of gas ports in the gas block to automatically reduce the volume of propellant gases directed into the gas system.

BRIEF DESCRIPTION OF THE DRAWINGS

These and other advantages and aspects of the embodiments of the disclosure will become apparent and more readily appreciated from the following detailed description of the embodiments taken in conjunction with the accompanying drawings, as follows.

DETAILED DESCRIPTION

Figure 1:
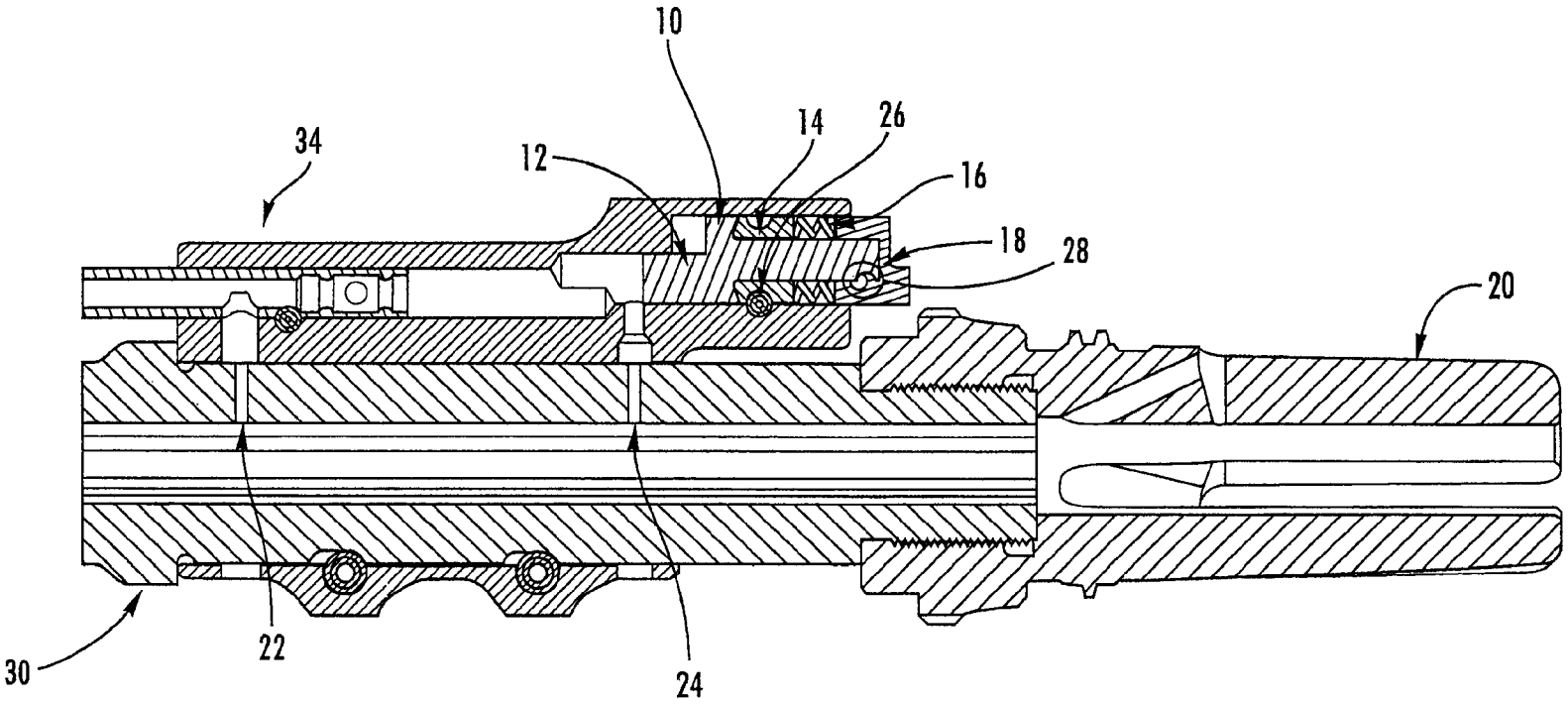
FIG. 1 illustrates a side cross-sectional view of the gas system regulator mechanism when a suppressor is not installed in accordance with an exemplary embodiment.

The following description is provided as an enabling teaching of embodiments of the invention. Those skilled in the relevant art will recognize that many changes can be made to the embodiments described, while still obtaining the beneficial results. It will also be apparent that some of the desired benefits of the embodiments described can be obtained by selecting some of the features of the embodiments without utilizing other features. Accordingly, those who work in the art will recognize that many modifications and adaptations to the embodiments described are possible and may even be desirable in certain circumstances. Thus, the following description is provided as illustrative of the principles of the invention and not in limitation thereof, since the scope of the invention is defined by the claims.

In one exemplary embodiment, the gas-operated mechanism of an auto loading rifle can be adjusted automatically when a suppressor is attached to the muzzle of the rifle. The gas system could be applied to both direct gas impingement operated weapons and piston operated weapons. An embodiment is described below in which the self regulating gas system is applied to a direct impingement system.

A barrel for an autoloading rifle may have a suppressor attached to the muzzle end of the weapon. The barrel comprises a chamber to accept a cartridge, a bore, one or more gas orifices (ports), and a muzzle.

A gas block can be attached to the barrel to redirect the propellant gases to cycle the action of the weapon either through the use of a gas tube that redirects the gases into the bolt carrier group in a direct impingement rifle, or through the use of a piston system that cycles the weapon with direct mechanical force.

In an exemplary embodiment in a direct impingement weapon, the barrel can have two gas ports that redirect propellant gases from the bore of the barrel into gas passages in the gas block. The first gas port and passage redirects the propellant gas into the gas tube. The propellant gas is then passed down the gas tube into the bolt carrier group where the gas acts in a standard method to cycle the action of the weapon. A second gas port redirects additional propellant gases into a bore that may or may not be concentric to the gas tube, but allows gas from this second port to be redirected into the gas tube.

As depicted in FIGS. 1-6, in one embodiment a spring loaded plunger assembly 10 is positioned within a larger bore of the gas block 34 and is oriented parallel with the bore of the barrel 30 of firearm F. A flash hider/flash suppressor 20 could be mounted over the muzzle end of barrel 30. The plunger assembly 10 can include a regulator plunger 12, regulator bushing 14, regulator spring 16, and regulator cap 18. The plunger assembly 10 may be removed from the gas block 34 as a unit and can be retained by a device such as a cross pin 26 to prevent forward and rearward motion of the regulator bushing 14. The regulator plunger 12 can have a small diameter shaft that is offset to the operating bore of the regulator bushing 14. This small diameter shaft operates within the bore for the second gas port 24. A larger diameter section of the regulator plunger 12 operates within the regulator bore of the gas block 34 and interfaces with the rear surface of the regulator bushing 14 when the plunger is held forward by the regulator spring 16. This interface surface prevents the forward flow of propellant gases from exiting the gas block 34. Another smaller diameter section of the regulator plunger 12 extends through the regulator bushing 14 and towards the front end of the gas block 34. The regulator cap 18 slides over the end of the small diameter of the regulator plunger 12 and is retained by a cross pin 28. The regulator cap 18 captures the regulator spring 16 in a slightly compressed state between the forward face of the regulator bushing 14 and the regulator cap 18. The regulator spring 16 operates within the regulator bore on the gas block 34 and surrounds the small diameter of the regulator plunger 12. The regulator cap 18 extends out the front end of the gas block 34 towards the muzzle.

Figure 4:
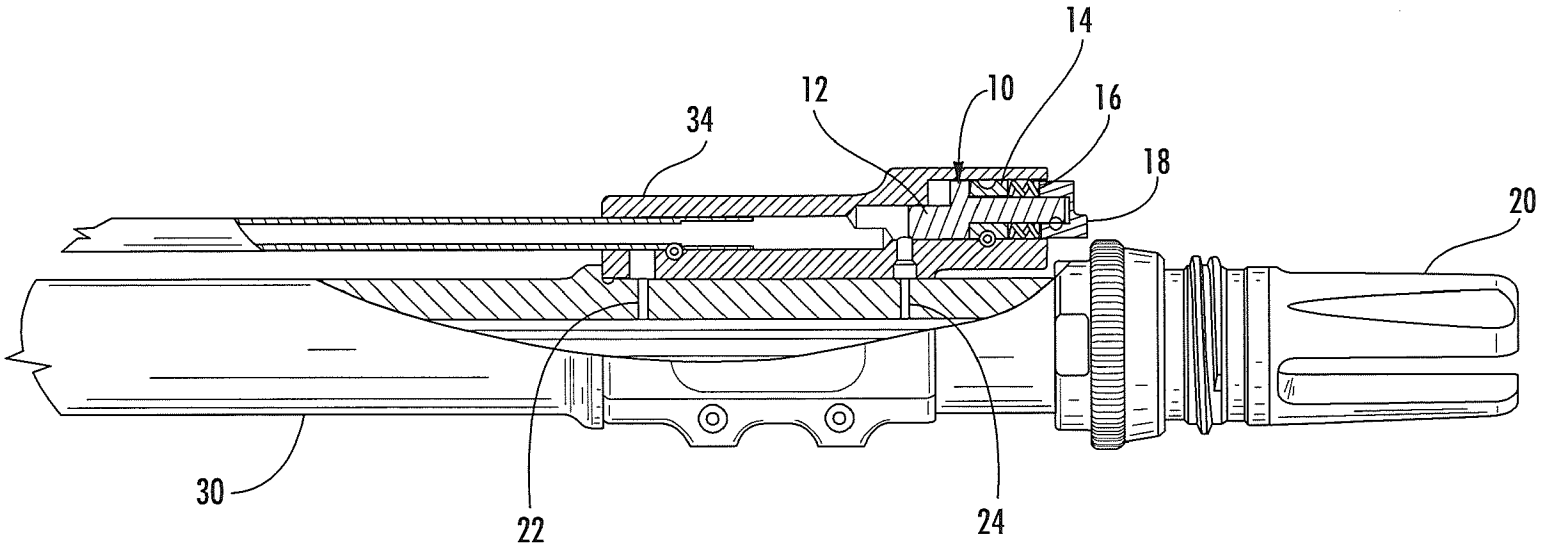
FIG. 4 illustrates a side cross-sectional view of the gas system regulator mechanism when a suppressor is not installed in accordance with an exemplary embodiment.
Figure 5:
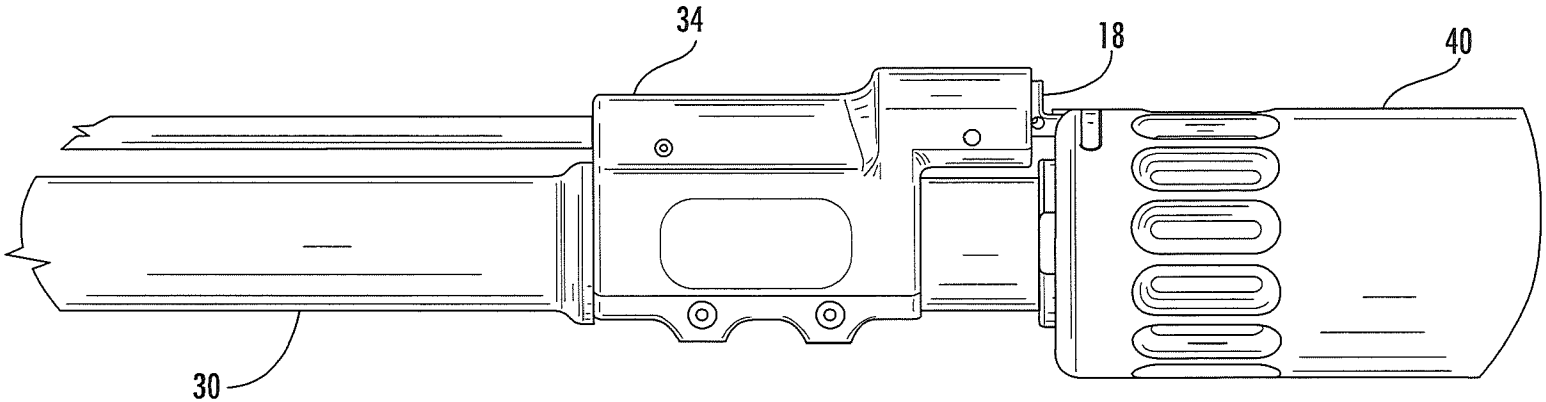
FIG. 5 illustrates a side view of the gas system regulator mechanism when a suppressor is installed in accordance with an exemplary embodiment.

As best illustrated in FIGS. 1 and 4, when a sound suppressor is not installed, the regulator plunger 12 is typically held forward by the regulator spring 16 such that the rearmost small diameter shaft of the regulator plunger 12 does not block the second gas port 24 in the barrel 30 and gas block 34, allowing both gas ports 22, 24 to provide energy to cycle the weapon. In other words, both the primary 22 and secondary ports 24 are used to supply gas to the gas tube.

When the weapon fires unsuppressed, the regulator plunger 12 may cycle backward on contra-recoil, wiping the surfaces to keep carbon from building up. The seal between the regulator plunger 12 and regulator bushing 14 prevents gas from getting into the regulator spring 16. FIGS. 1 and 4 further show a flash hider 20 installed on the muzzle end of barrel 30.

Figure 2:
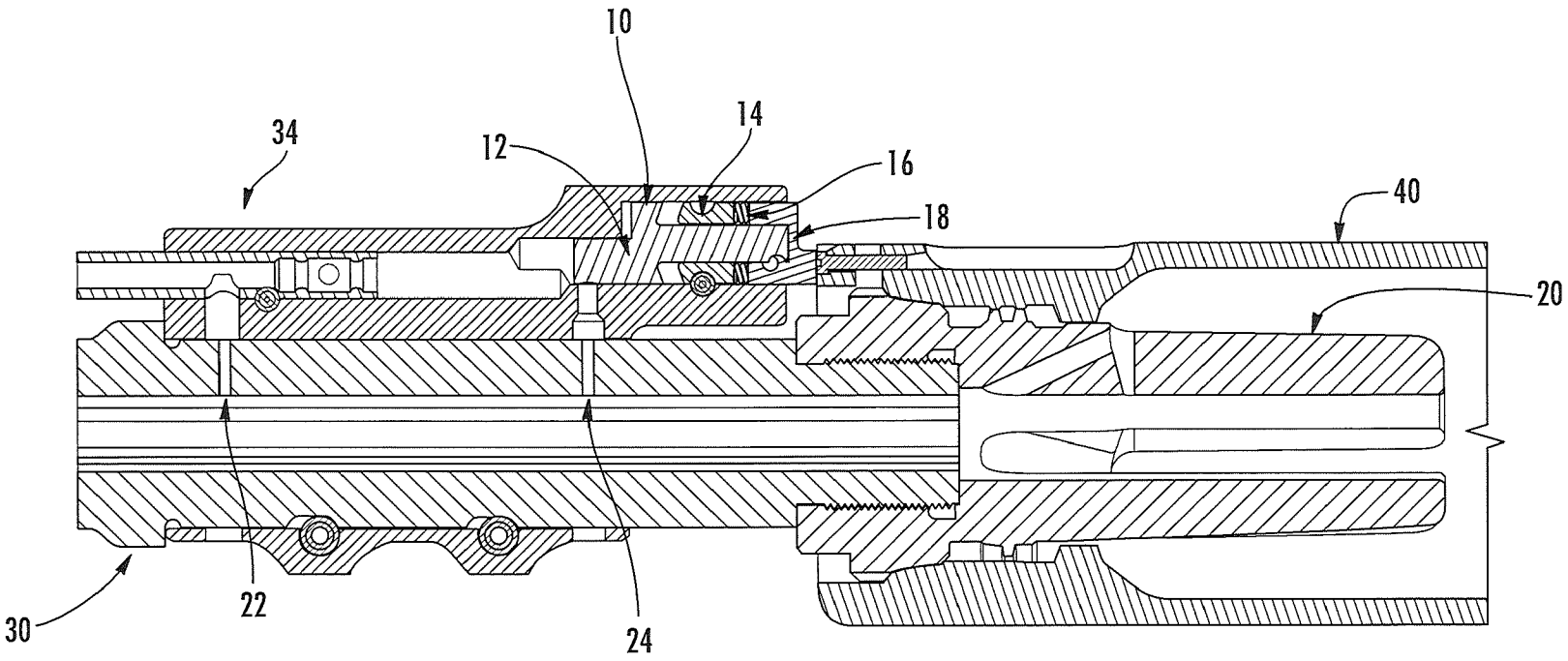
FIG. 2 illustrates a side cross-sectional view of the gas system regulator mechanism when a suppressor is installed in accordance with an exemplary embodiment.
Figure 3:
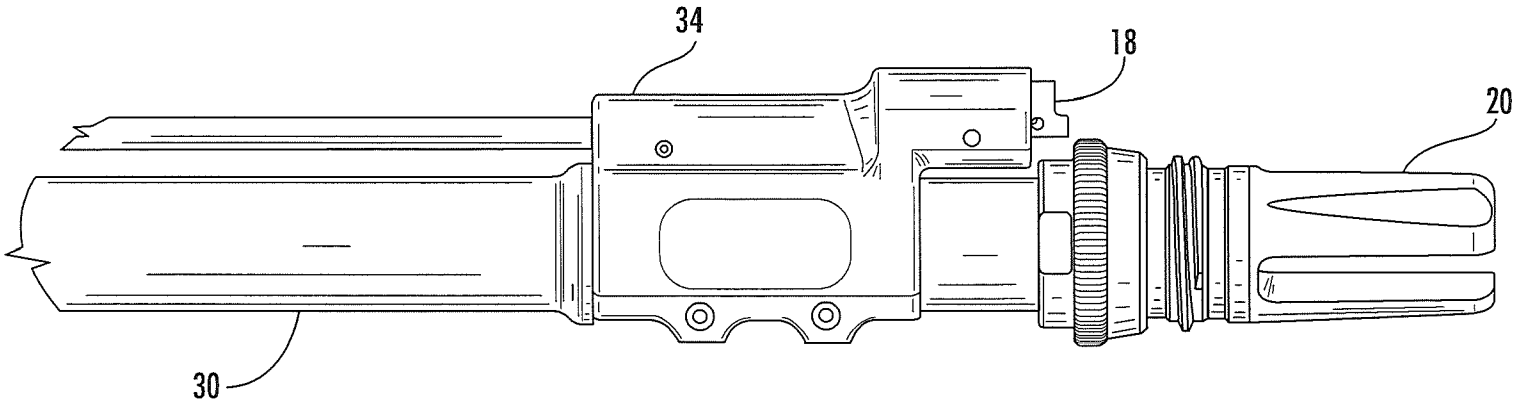
FIG. 3 illustrates a side view of the gas system regulator mechanism when a suppressor is not installed in accordance with an exemplary embodiment.
Figure 6:
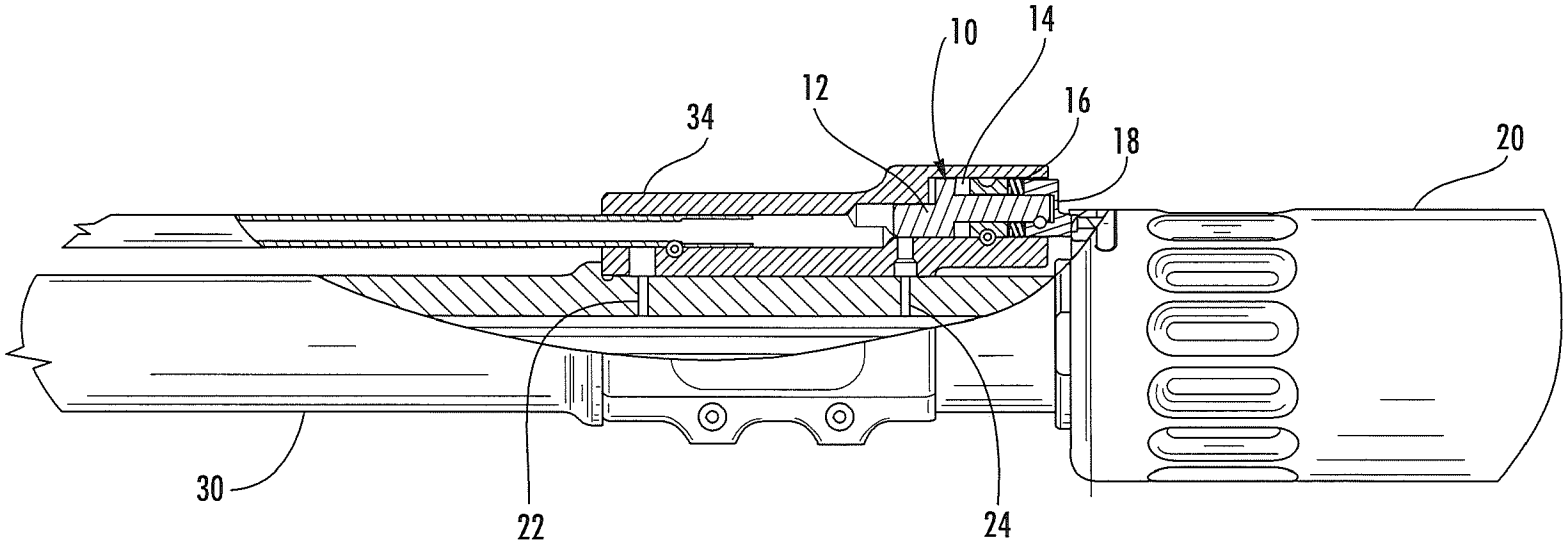
FIG. 6 illustrates a side cross-sectional view of the gas system regulator mechanism when a suppressor is installed in accordance with an exemplary embodiment.

As best illustrated in FIGS. 2 and 6, when a sound suppressor 40 is attached to the firearm F over the flash hider 20, the body of the sound suppressor 40 depresses the spring loaded plunger assembly 10 such that the rearmost small diameter shaft of the regulator plunger 12 is moved rearward in its bore and cuts off the gas flow from the second gas port 24 in the barrel 30, leaving only the gas from the first gas port 22 able to provide energy to cycle the weapon.

When the sound suppressor 40 is installed, the regulator plunger 12 is pushed back by the suppressor body. The regulator plunger 12 blocks the secondary port 24, leaving only the primary port 22 and residual bore pressure to cycle the weapon. The sound suppressor 40 prevents the pressure from the primary port 22 from pushing the regulator plunger 12 forward.

Should the system need service, the removal of the retaining pin 26 holding in the regulator bushing 14 allows the entire regulator assembly 10 to come out the front of the gas block 34 past the flash hider 20.

The embodiments described do not require an operator to manually switch his weapon between suppressed and unsuppressed settings when installing a suppressor 40. The unique features of the disclosed embodiment include the use of a plunger 12 that is detented by the installation of the suppressor 40, as well as the use of two gas ports 22, 24 in the barrel 30 to achieve this result.

In another embodiment of this system, the above-described two port system could be used to drive the piston on a piston operated system and/or use a single port in the barrel 30. The plunger 12 could contain a reduced diameter orifice that reduces the effective diameter of the gas port 24 and could redirect this gas into the gas tube 34 or piston chamber when the regulator plunger 12 is depressed.

The corresponding structures, materials, acts, and equivalents of all means plus function elements in any claims below are intended to include any structure, material, or acts for performing the function in combination with other claim elements as specifically claimed.

Those skilled in the art will appreciate that many modifications to the exemplary embodiments are possible without departing from the scope of the present invention. In addition, it is possible to use some of the features of the embodiments disclosed without the corresponding use of the other features. Accordingly, the foregoing description of the exemplary embodiments is provided for the purpose of illustrating the principles of the invention, and not in limitation thereof, since the scope of the invention is defined solely by the appended claims.

What is claimed:

1. A self-regulating gas system for an auto loading weapon wherein the weapon includes a barrel having a bore, at least one gas port, and a muzzle, the gas system comprising:

a gas block attached to the barrel to redirect a volume of propellant gases to cycle the auto loading weapon, the gas block including a plurality of gas ports for directing propellant gases received from the at least one gas port of the barrel into the gas system of the auto loading weapon; and a spring-loaded plunger assembly positioned within a bore of the gas block and oriented parallel to the bore of the barrel, the plunger assembly including a regulator plunger having a plurality of sections, a regulator bushing, a regulator spring, and a regulator cap;

wherein the regulator plunger is configured to move rearwardly when a suppressor is mounted over the muzzle, the rearward movement of the regulator plunger sufficient to substantially block one of gas ports in the gas block to reduce the volume of propellant gases directed into the gas system.

2. The self-regulating gas system for an auto loading weapon of claim 1 wherein the regulator plunger comprises a first section that is offset to an operating bore of the regulator bushing.

3. The self-regulating gas system for an auto loading weapon of claim 2 wherein the offset first section of the regulator plunger operates within the operating bore for one gas port in the gas block.

4. The self-regulating gas system for an auto loading weapon of claim 2 wherein the regulator plunger comprises a second section operating within the regulator bore of the gas block and interfacing with a rear surface of the regulator bushing when the plunger is held forward by the regulator spring.

5. The self-regulating gas system for an auto loading weapon of claim 4 wherein the interface of the second section of the regulator plunger with the rear surface of the regulator bushing prevents a forward flow of propellant gases from exiting the gas block.

6. The self-regulating gas system for an auto loading weapon of claim 4 wherein the regulator plunger further comprises a third section extending through the regulator bushing and towards a front end of the gas block.

7. The self-regulating gas system for an auto loading weapon of claim 6 wherein the regulator cap is slideably mounted over an end of the third section and is retained by a cross pin.

8. The self-regulating gas system for an auto loading weapon of claim 1 wherein the regulator cap compresses the regulator spring between a forward face of the regulator bushing and the regulator cap.

9. The self-regulating gas system for an auto loading weapon of claim 6 wherein the regulator spring operates within the regulator bore on the gas block and is mounted over the third section of the regulator plunger.

10. The self-regulating gas system for an auto loading weapon of claim 1 wherein a portion of the regulator cap extends past the front end of the gas block towards the muzzle and is driven rearward when the suppressor is mounted over the muzzle, the rearward movement of the regulator cap driving the regulator plunger rearward to reduce the flow of propellant gases into the gas system through the plurality of gas ports.

11. The self-regulating gas system for an auto loading weapon of claim 1 further comprising a cross pin inserted into the plunger assembly for retaining the plunger assembly in position in the bore of the gas block to prevent movement of the regulator bushing.

12. The self-regulating gas system for an auto loading weapon of claim 1 wherein each of the plurality of regulator plunger sections comprises a cross-section that varies with a corresponding position of each section within the gas block.

13. The self-regulating gas system for an auto loading weapon of claim 1 wherein mounting the suppressor over the muzzle prevents a gas pressure of propellant gases freely entering one gas port from pushing the regulator plunger in a forward direction.

14. A method for self regulation of propellant gases in an autoloading weapon wherein the weapon includes a barrel having a bore, at least one gas port, and a muzzle, comprising:

attaching a gas block to the barrel to redirect a volume of propellant gases to cycle the auto loading weapon, the gas block including a plurality of gas ports for directing propellant gases received from the at least one gas port of the barrel into the gas system of the auto loading weapon;

positioning a spring-loaded plunger assembly within a bore of the gas block and oriented parallel to the bore of the barrel, the plunger assembly including a regulator plunger having a plurality of sections, a regulator bushing, a regulator spring, and a regulator cap; and mounting a suppressor over the muzzle to depress the regulator plunger, a rearward movement of the regulator plunger blocking one of the gas ports in the gas block to automatically reduce the volume of propellant gases directed into the gas system.

15. The method for self regulation of propellant gases of claim 14 wherein a first section of the regulator plunger is offset to an operating bore of the regulator bushing.

16. The method for self regulation of propellant gases of claim 14 wherein a second section of the regulator plunger operates within the regulator bore.

17. The method for self regulation of propellant gases of claim 16 further comprising interfacing the second section of the regulator plunger with a rear surface of the regulator bushing when the plunger is held forward by the regulator spring to prevent a forward flow of propellant gases from exiting the gas block.

18. The method for self regulation of propellant gases of claim 16 wherein a third section of the regulator plunger extends through the regulator bushing and towards a front end of the gas block.

19. The method for self regulation of propellant gases of claim 18 further comprising sliding the regulator cap over an open end of the third section of the regulator plunger and retaining the regulator cap with a cross pin.

20. The method for self regulation of propellant gases of claim 19 wherein sliding the regulator cap over the open end of the regulator plunger compresses the regular spring mounted over the third section of the regulator plunger between a forward face of the regulator bushing and the regulator cap.

21. The method for self regulation of propellant gases of claim 14 wherein mounting the suppressor over the muzzle drives a portion of the regulator cap extending past the front end of the gas block rearward when the suppressor contacts the regulator cap, the rearward movement of the regulator cap driving the regulator plunger rearward to reduce the flow of propellant gases into the gas system.

22. The method for self regulation of propellant gases of claim 14 further comprising inserting a cross pin into the plunger assembly to prevent movement of the regulator bushing.

23. A self-regulating gas system for firearm including a barrel, at least one gas port, and a muzzle, the gas system comprising:

a gas block attached to the barrel to redirect a volume of propellant gases to cycle the auto loading weapon, the gas block including a plurality of gas ports for directing propellant gases received from the at least one gas port of the barrel into the gas system;

a spring-loaded plunger assembly positioned within the gas block, the plunger assembly including a regulator plunger, a regulator bushing, a regulator spring, and a regulator cap; the regulator plunger configured to be urged rearward when a suppressor is mounted over the muzzle, to a position sufficient to substantially block or reduce a cross-sectional area of one of the gas ports in the gas block to reduce the volume of propellant gases directed into the gas system.

24. The self-regulating gas system for an auto loading weapon of claim 23 wherein the regulator cap compresses the regulator spring between a forward face of the regulator bushing and the regulator cap.

25. The self-regulating gas system for an auto loading weapon of claim 23 wherein a portion of the regulator cap extends past the front end of the gas block towards the muzzle and is driven rearward when the suppressor is mounted over the muzzle, the rearward movement of the regulator cap driving the regulator plunger rearward to reduce the flow of propellant gases into the gas system through the plurality of gas ports.

26. The self-regulating gas system for an auto loading weapon of claim 23 further comprising a cross pin inserted into the plunger assembly for retaining the plunger assembly in position in the bore of the gas block to prevent movement of the regulator bushing.

27. The self-regulating gas system for an auto loading weapon of claim 23 wherein mounting the suppressor over the muzzle prevents a gas pressure of propellant gases freely entering one gas port from pushing the regulator plunger in a forward direction.

* * * * *